United States Patent [19]

de Munck

[11] 4,199,158

[45] Apr. 22, 1980

[54] PROFILED GASKET FOR SEALING TUNNEL SEGMENT JOINTS

[75] Inventor: Eduard H. L. de Munck, The Hague, Netherlands

[73] Assignee: Vredestein N.V., The Hague, Netherlands

[21] Appl. No.: 961,903

[22] Filed: Nov. 20, 1978

[30] Foreign Application Priority Data

Nov. 23, 1977 [NL] Netherlands ..... 7712894

[51] Int. Cl.[2] ..... F16J 15/10; E01G 1/00

[52] U.S. Cl. ..... 277/205; 277/211; 404/65; 405/135; 405/147; 52/396; 52/403; 49/475

[58] Field of Search ..... 277/27, 3, 205, 206 R, 277/206 A, 207 R, 211, 213, 166, 34, 34.3, 34.6; 404/65, 64; 405/135, 147; 49/475; 52/396, 403

[56] References Cited

U.S. PATENT DOCUMENTS

| | | | |
|---|---|---|---|
| 2,230,303 | 2/1941 | Leguillon | 404/65 |
| 3,363,383 | 1/1968 | La Barge | 404/65 X |
| 3,367,693 | 2/1968 | Weltman | 277/211 X |
| 3,750,411 | 8/1973 | Shimizu | 405/135 |
| 3,831,950 | 8/1974 | Bentley et al. | 277/211 X |
| 4,045,037 | 8/1977 | Pippert | 277/205 |

*Primary Examiner*—Robert S. Ward, Jr.
*Attorney, Agent, or Firm*—Karl W. Flocks

[57] ABSTRACT

Profiled gasket for sealing tunnel segment joints, which is placed in a receiving groove in this segment and which is made of a body of rubber or an elastically deformable synthetic material, said body having at the one side two outer legs, within which there at least two inner legs, a slot being provided between each two legs, at least the upper part of the slot formed by each outer leg and its neighboring inner leg lying within the outer plane of the other side of the body.

4 Claims, 4 Drawing Figures

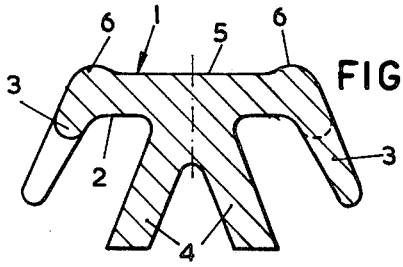
FIG. 1
FIG. 2
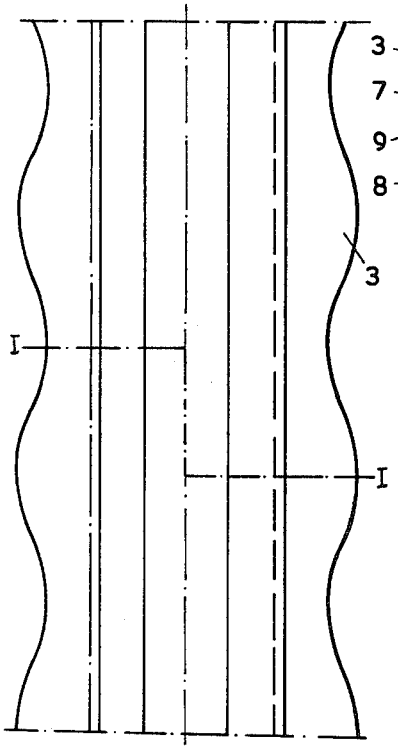
FIG. 3
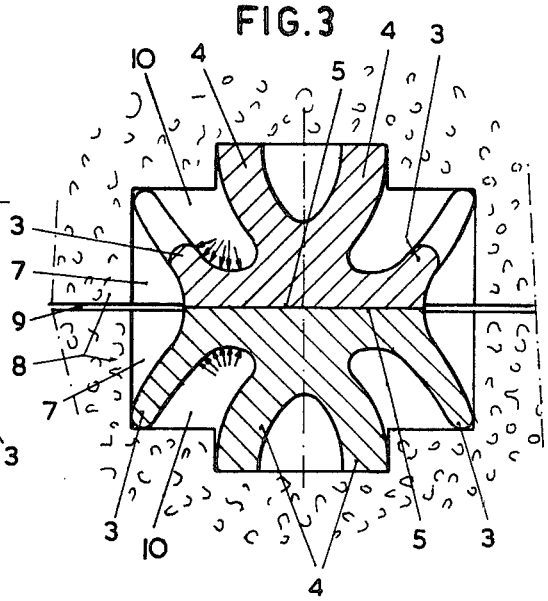
FIG. 4
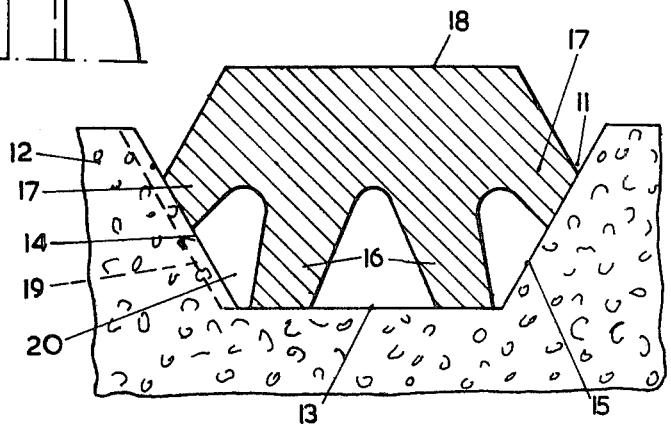

PROFILED GASKET FOR SEALING TUNNEL SEGMENT JOINTS

The invention relates to a profiled gasket for sealing tunnel segment joints of tunnels built up of segments, each segment being provided with such a profiled gasket, arranged therearound and put in a receiving groove provided in this segment and which consists of a rubber or elastically deformable body of synthetic material.

With tunnels that are built up of concrete blocks, which are usually called segments, sealings must be provided in the spaces between each two adjacent segments. To that end, each of said segments are provided with grooves, in each of which a gasket is provided, so that between said gaskets there is a seam which, in order to prevent leaks must be well kept closed, so that both gaskets must be pressed against each other with a great pressure.

The sealings known so far for the tunnels built up of segments have the drawback, among others, that the admissible movement tolerances of the segments are small, namely in the order of 2 to 3 mm of compression per gasket because leaks occur otherwise. Furthermore, the seam between the gaskets of two adjacent segments will be split open already at a water pressure of about 10 meters, which also will cause leaks.

These drawbacks are avoided by the profiled gasket according to the invention, in that its body has at the one side of two of its opposite sides two outer legs, within which there are at least two inner legs, and a slot being provided between each two legs, of which slots at least the upper part of the slot formed by each outer leg and the neighbouring inner leg lies within the outer plane of the other side of the body. When such a profiled gasket is used, the receiving grooves in the segments must be arranged in such a way, that there are slots or other recesses between the groove walls and the outer legs lying against said groove walls, so that water may enter the spaces formed by these groove walls and outer leg of each gasket and its adjacent inner leg. Depending on the depth at which the tunnel lies, this water exerts a pressure on the wall of these spaces, which provides an extra sealing pressure between the profiled gasket. This extra sealing pressure may amount to 5 at or more.

The profiled gasket may also be carried out in such a way, that in the groove walls no slots or other recesses need to be provided in order to obtain, that water under pressure may enter the spaces between the outer and inner legs. To this end, the outer legs may be provided each with one or more holes or recesses. The inner legs then assure essentially the main pressure by which the gaskets are pressed against each other, whereas the water in the spaces between the outer and inner legs provided the extra sealing pressure.

The profiled gasket may be carried out in such a way, that the outer legs have a shorter length than the inner legs. This increases the stability of the sealing gasket. Preferably the outer legs are under a different angle with the center line of the gasket than the inner legs. Such a profiled gasket is destined for segments, of which the receiving groove has a flat bottom and obliquely erect walls.

The other side of the two opposite sides of the gasket may be flat or shaped in another way. The longitudinal zones of this side may e.g. be higher than the part there between.

The invention will be explained hereinafter with reference to the drawing, in which, by means of example, two embodiments of the profiled gasket according to the invention are shown.

In the drawing:

FIG. 1 shows a cross section of the first embodiment along the line I—I of FIG. 2;

FIG. 2 shows a view from below of this embodiment;

FIG. 3 shows a cross section of a part of two segments with two profiled gaskets lying against each other;

FIG. 4 shows a cross section of the second embodiment.

The profiled gasket shown in FIGS. 1–3 has a body 1 of rubber or an elastically deformable synthetic material, of which the one side 2 has two outer legs 3 and two inner legs 4. The other side 5 has a flat central part and two longitudinal zones 6 which are slightly higher than this central part. The outer legs 3 are shorter than the inner legs 4. The lower edge of each of said outer legs has a corrugated shape.

As results from FIG. 3, the gaskets are inserted each in a receiving groove 7 of a tunnel segment 8 in such a way, that the sides 5 thereof lie against each other. The grooves 7 are carried out stepwise. Against the bottom of the deepest part of each of the grooves 7 lie the inner legs 4 of the profiled gasket. These inner legs essentially provide the sealing pressure, by which the sealing gaskets are pressed against each other when the segments are pressed towards each other during the construction of a tunnel.

The outer legs 3 lie against the bottom of the shallow part of the grooves 7. As the lower edges of the outer legs are corrugated, the water can flow between the seams 9 of adjacent segments 8 in the outermost receiving slot 7 and in the spaces 10 between the inner and outer legs of the gaskets. By the pressure of the water entering the spaces 10 an extra sealing pressure is exerted on the parts of the gaskets lying above the upper parts of these spaces, in that these upper parts are provided in such a way, that they lie in planes which lie within the oppositely situated sides of the sealing strips 1.

FIG. 4 shows a cross section of an embodiment of the gasket, which is placed in a receiving groove 11 of a tunnel segment 12. This receiving groove has a flat bottom 13 and two oblique erect walls 14,15. The inner legs 16 lie against the bottom 13 of the receiving groove, whereas the outer legs 17 lie against the oblique side walls 14,15. The side 18 of this gasket is entirely flat.

In the groove wall 15, which comes to lie at the outer wall of the tunnel, one or a number of grooves 19 have been provided, so that water may enter the space 20, which provides an extra sealing pressure when the segments are arranged in the tunnel. The flat side 18 protrudes above the respective wall of the tunnel segment, which is also the case when it is in compressed condition in the tunnel, whereas still a good sealing against leaking water is obtained.

It will be obvious that the invention is not restricted to the embodiments shown in the drawing and described in the specification, but that it may be carried out in numerous other ways without leaving the scope of the invention.

Instead of corrugated longitudinal edges of the outer legs of the gaskets or instead of grooves in the walls of the receiving grooves for said gaskets the outer legs of the gaskets may also be provided with holes or other recesses. The gaskets are shown symetrical, but it will be obvious, that only one outer leg need be provided with holes or recesses, namely that outer leg, which will come to lie at the outside of the tunnel.

I claim:

1. A profiled gasket for sealing tunnel segments of tunnels built up of segments, each segment being provided with such a profiled gasket running therearound, arranged and provided in a receiving groove provided in this segment and which is made of a body of rubber or an elastically deformable synthetic material, characterized in that this body has at the one side of two of its opposite sides two outer legs, within which there are at least two inner legs, a slot being provided between each two legs, at least the upper part of the slot formed by each outer leg with the neighbouring inner leg lying within the outer plane of the other side of the body, each of the outer legs also provided with one or more holes or recesses.

2. A profiled gasket according to claim 1, characterized in that the outer legs have a shorter length than the inside legs.

3. A profiled gasket according to claim 2, characterized in that the lower plane of the outer legs makes a different angle with the center line of the gasket than the inner legs.

4. A profiled gasket according to claim 3, characterized in that each of the longitudinal zones of the other of the two opposite sides are higher than the part lying therebetween.

* * * * *